US010054014B1

(12) United States Patent
West et al.

(10) Patent No.: US 10,054,014 B1
(45) Date of Patent: Aug. 21, 2018

(54) LATCHING ARRANGEMENT FOR SWITCHABLE ROCKER ARM

(71) Applicant: DELPHI TECHNOLOGIES IP LIMITED, St. Michael (BB)

(72) Inventors: Joseph M. West, Rochester, NY (US); Ian R. Jermy, Leroy, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 26 days.

(21) Appl. No.: 15/437,039

(22) Filed: Feb. 20, 2017

(51) Int. Cl.
*F01L 1/18* (2006.01)
*F01L 1/047* (2006.01)
*F01L 1/24* (2006.01)

(52) U.S. Cl.
CPC ..... *F01L 1/181* (2013.01); *F01L 1/047* (2013.01); *F01L 1/2416* (2013.01); *F01L 2001/186* (2013.01)

(58) Field of Classification Search
CPC ..... F01L 1/181; F01L 1/047; F01L 1/2416; F01L 2001/186
USPC ..... 123/90.36, 90.39, 90.44
See application file for complete search history.

(56) References Cited

U.S. PATENT DOCUMENTS 6,925,978 B1 8/2005 Gerzseny et al.
7,305,951 B2 12/2007 Fernandez et al.
7,882,814 B2 * 2/2011 Spath ..... F01L 1/185 123/90.39
9,534,511 B2 1/2017 Lee et al.

* cited by examiner

*Primary Examiner* — Ching Chang
(74) *Attorney, Agent, or Firm* — Joshua M. Haines

(57) ABSTRACT

A rocker arm includes an outer arm; an inner arm which selectively pivots relative to the outer arm; and a latching arrangement which switches the rocker arm between a coupled state and a decoupled state. The latching arrangement includes a connecting bore which is terminated by a connecting bore floor; an oil supply bore which opens into the connecting bore through the connecting bore floor; a lock pin bore which opens into the connecting bore through the connecting bore floor; a lock pin within the lock pin bore where the lock pin prevents the inner arm from pivoting in the coupled state and where the lock pin permits the inner arm to pivot in the coupled state; and a retainer within the connecting bore which defines a chamber within the connecting bore which provides fluid communication between the oil supply bore and the lock pin bore.

14 Claims, 4 Drawing Sheets

LATCHING ARRANGEMENT FOR SWITCHABLE ROCKER ARM

TECHNICAL FIELD OF INVENTION

The present invention relates to a rocker arm for valve train of an internal combustion engine; more particularly to a rocker arm with an inner arm which selectively pivots relative to an outer arm, and even more particularly to a latching arrangement which selectively couples the inner arm to the outer arm and which selectively decouples the inner arm from the outer arm.

BACKGROUND OF INVENTION

Variable valve activation mechanisms for internal combustion engines are well known. It is known to lower the lift, or even to provide no lift at all, of one or more valves of an internal combustion engine, during periods of light engine load. Such valve deactivation or valve lift switching can substantially improve fuel efficiency.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second and lesser valve lift mode, that is greater than no lift. It should be noted that the second valve lift mode may provide one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm where the inner arm includes an inner arm follower which follows a first profile of a camshaft of the internal combustion engine and where the outer arm includes a pair of outer arm followers which follow respective second and third profiles of the camshaft. The follower of the inner arm and the followers of the outer arm may be either sliding surfaces or rollers and combinations thereof. The inner arm is movably connected to the outer arm and can be switched from a coupled state wherein the inner arm is immobilized relative to the outer arm, to a decoupled state wherein the inner arm can move relative to the outer arm. Typically, the outer arm of the switchable rocker arm is pivotally supported at a first end by the hydraulic lash adjuster which fits into a socket of the outer arm. A second end of the outer arm operates against an associated engine valve for opening and closing the valve by the rotation of an associated eccentric cam lobe acting on the follower of the inner arm. The inner arm is connected to the outer arm for pivotal movement about the outer arm's second end with the follower of the inner arm disposed between the first and second ends of the outer arm. Switching between the coupled state and the decoupled state is accomplished through a lock pin which is slidingly positioned in a lock pin bore of the outer arm. One end of the lock pin is moved into and out of engagement with the inner arm. Consequently, when the lock pin is engaged with the inner arm, the coupled state is achieved. Conversely, when the lock pin is not engaged with the inner arm, the decoupled state is achieved. As shown in U.S. Pat. No. 7,305,951 to Fernandez et al., the disclosure of which is hereby incorporated by reference in its entirety, the other end of the lock pin acts as a piston upon which pressurized oil is applied and vented to affect the position of the lock pin. Also as shown by Fernandez et al., oil is supplied to the lock pin via an oil supply bore which originates in the socket and breaks into the lock pin bore. Due to the geometric relationship between the socket and the piston end of the lock pin, the oil supply bore is oblique to the lock pin bore. As a result of the inclined nature of the oil supply bore breaking into the lock pin bore, it is not practical to initiate the hole from the lock pin bore, and consequently, formation of the oil supply bore is initiated from the socket which results in challenges in forming the oil supply bore. More specifically, tooling with a relatively small diameter compared to its length is needed, and consequently, tooling breakage is frequent.

What is needed is a rocker arm which minimizes or eliminates one or more of the shortcomings as set forth above.

SUMMARY OF THE INVENTION

Briefly described, a rocker arm is provided for transmitting rotational motion from a camshaft to opening and closing motion of a combustion valve in an internal combustion engine. The rocker arm includes an outer arm with an outer follower; an inner arm which selectively pivots relative to the outer arm, the inner arm having an inner follower; and a latching arrangement which switches the rocker arm between a coupled state and a decoupled state. The latching arrangement includes a connecting bore which extends into the outer arm, the connecting bore being centered about and extending along a connecting bore axis such that the connecting bore is terminated by a connecting bore floor; an oil supply bore in the outer arm which opens into the connecting bore through the connecting bore floor, the oil supply bore being centered about and extending along an oil supply bore axis; a lock pin bore in the outer arm which opens into the connecting bore through the connecting bore floor, the lock pin bore being centered about and extending along a lock pin bore axis; a lock pin located within the lock pin bore where the lock pin slides along the lock pin bore axis such that in the coupled state, the lock pin prevents the inner arm from pivoting relative to the outer arm past a predetermined position in a first direction and such that in the decoupled state the lock pin permits the inner arm to pivot relative to the outer arm past the predetermined position in the first direction; and a retainer within the connecting bore which defines a chamber within the connecting bore which provides fluid communication between the oil supply bore and the lock pin bore. The latching arrangement described herein eases manufacturing and reduces costs as will be more readily apparent from a thorough reading of the following description.

BRIEF DESCRIPTION OF DRAWINGS

This invention will be further described with reference to the accompanying drawings in which.

DETAILED DESCRIPTION OF INVENTION

Figure 1:
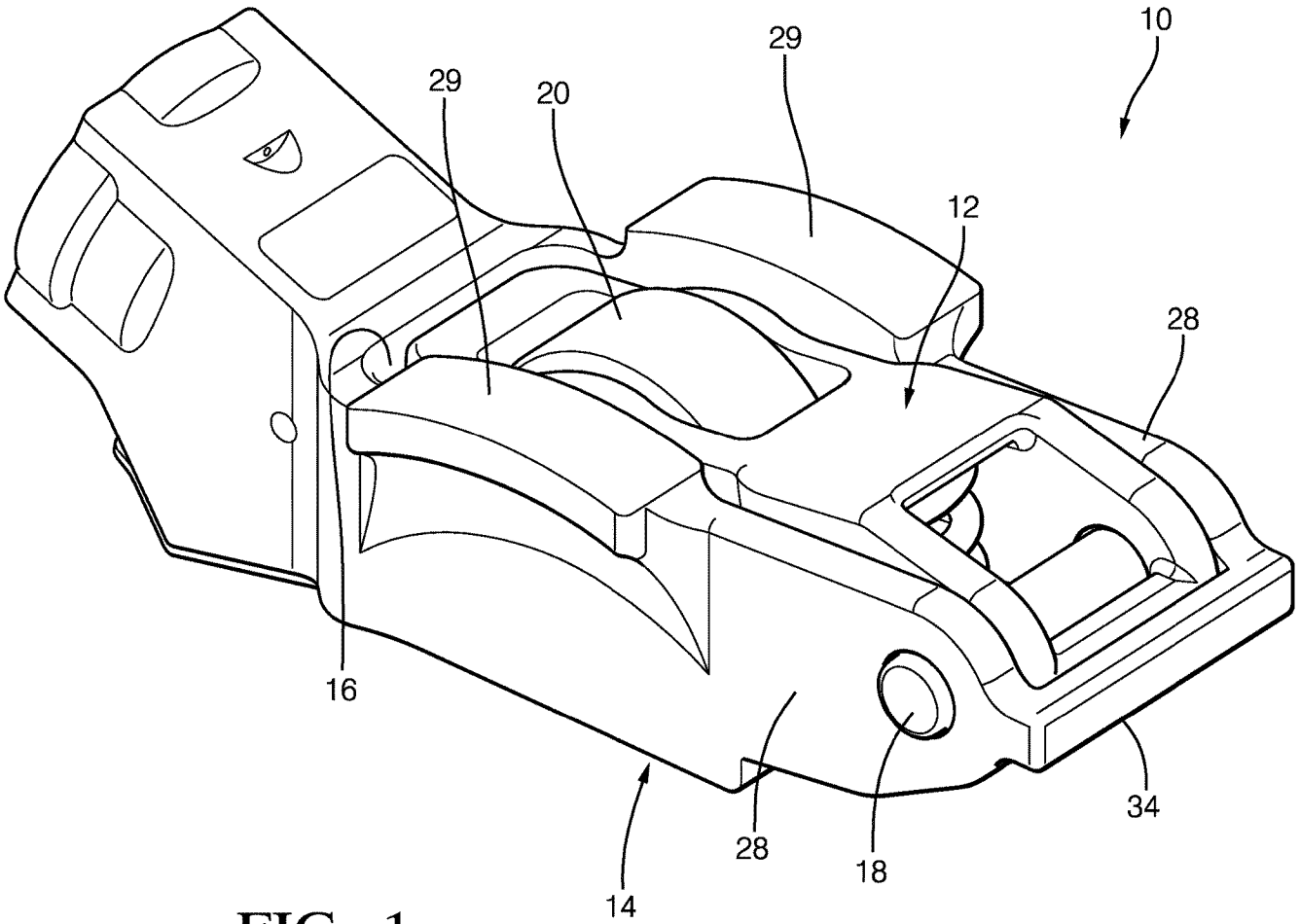
FIG. 1 is an isometric view of a rocker arm in accordance with the present invention.

Referring to FIGS. 1-4, a rocker arm 10 in accordance with the invention is illustrated where rocker arm 10 is either a two-step rocker arm or a deactivation rocker arm, which may generically be referred to as a switchable rocker arm. Rocker arm 10 is included in valve train (not shown) of an internal combustion engine (not shown) in order to translate rotational motion of a camshaft (not shown) to reciprocating motion of a combustion valve (not shown). Rocker arm 10 includes an inner arm 12 that is pivotably disposed in a central opening 16 in an outer arm 14. Inner arm 12 selectively pivots within outer arm 14 about a pivot shaft 18. Inner arm 12 includes a follower illustrated as a roller 20 carried by a roller shaft 22 that is supported by inner arm 12 such that roller 20 and roller shaft 22 are centered about a roller shaft axis 24. Roller 20 is configured to follow a lobe of the camshaft, for example a high-lift lobe, to impart lifting motion on a respective combustion valve. A bearing 26 may rotatably support roller 20 on roller shaft 22 for following a cam lobe of a lifting cam of an engine camshaft (not shown). Bearing 26 may be, for example, a plurality of rollers or needle bearings. Roller shaft 22 is fixed to inner arm 12, by way of non-limiting example only, by staking each end of roller shaft 22 in order to cause each end of roller shaft 22 to be increased in diameter to prevent removal from inner arm 12. Outer arm 14 includes two walls 28 positioned parallel to each other such that walls 28 are perpendicular to roller shaft axis 24 and such that walls 28 are spaced apart from each other to define central opening 16 therebetween. Outer arm 14 also includes followers 29 such that one follower 29 is fixed to each wall 28. As shown, followers 29 may be sliding surfaces, but may alternatively be rollers. Followers 29 are configured to follow respective lobes of the camshaft, for example low-lift lobes which impart lifting motion on a respective combustion valve or null lobes which do not impart lifting motion on a respective combustion valve. A lost motion spring 30 acts between inner arm 12 and outer arm 14 to pivot inner arm 12 away from outer arm 14. A socket 32 for pivotably mounting rocker arm 10 on a lash adjuster (not shown) is included at a first end 14*a* of outer arm 14 while a pad 34 for actuating a valve stem (not shown) is included at a second end 14*b* of outer arm 14. A latching arrangement 36 disposed within outer arm 14 at first end 14*a* thereof selectively permits inner arm 12 to pivot relative to outer arm 14 about pivot shaft 18 and also selectively prevents inner arm 12 from pivoting relative to outer arm 14 about pivot shaft 18. While the follower of inner arm 12 has been illustrated as roller 20, it should be understood that the follower of inner arm 12 may alternatively be a sliding surface as shown in U.S. Pat. No. 7,305,951 to Fernandez et al. Similarly, while followers 29 of outer arm 14 have been illustrated as sliding surfaces, it should be understood that followers 29 may alternatively be rollers as shown in U.S. Pat. No. 7,305,951. It should also be understood that the followers of inner arm 12 and outer arm 14 may all be rollers or may all be sliding surfaces.

Figure 2:
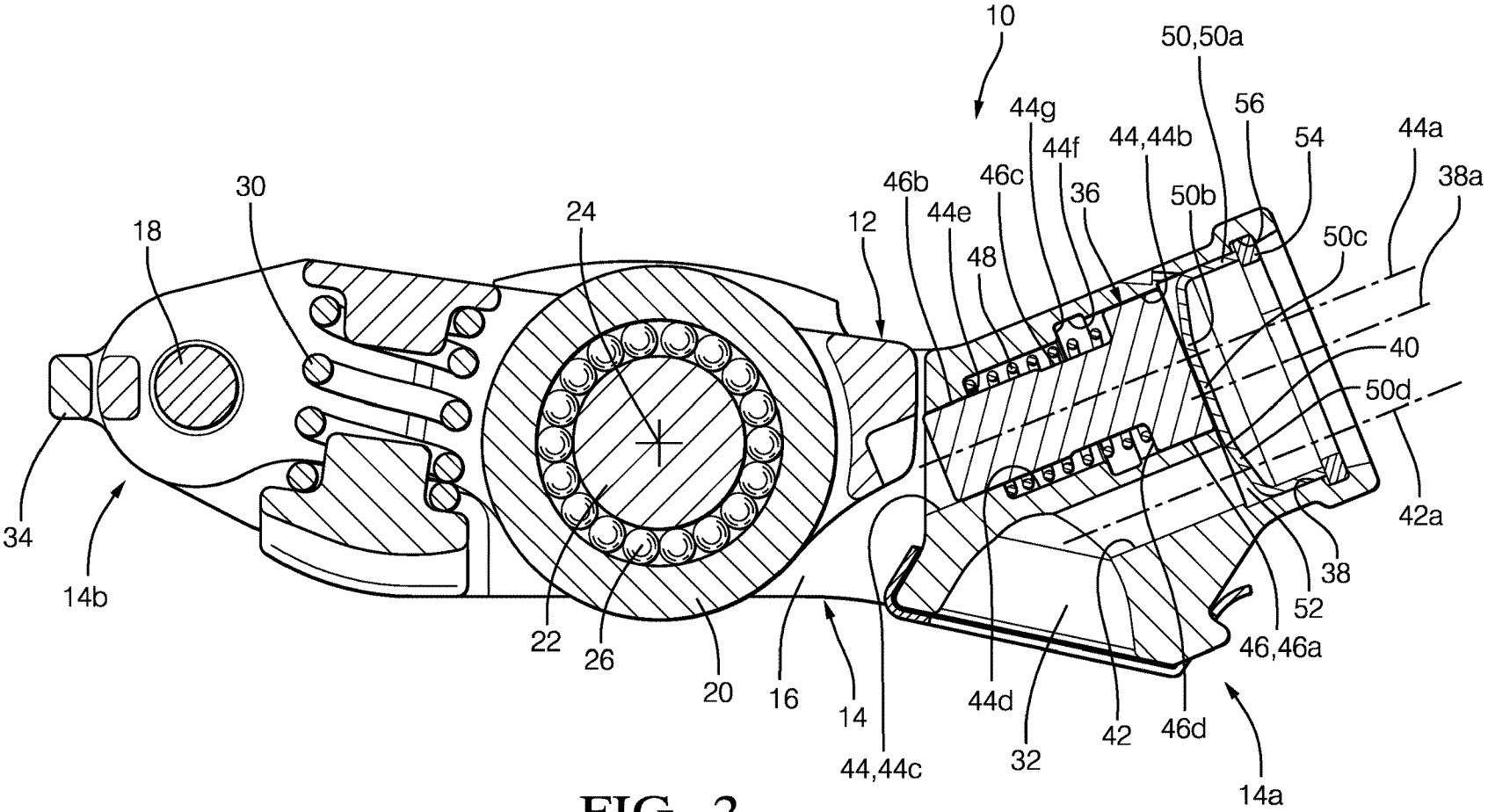
FIG. 2 is a cross-sectional view of the rocker arm of FIG. 1, taken through a first plane that is perpendicular to an axis of rotation of a central follower of the rocker arm, showing a latching arrangement of the rocker arm in a decoupled state.
Figure 3:
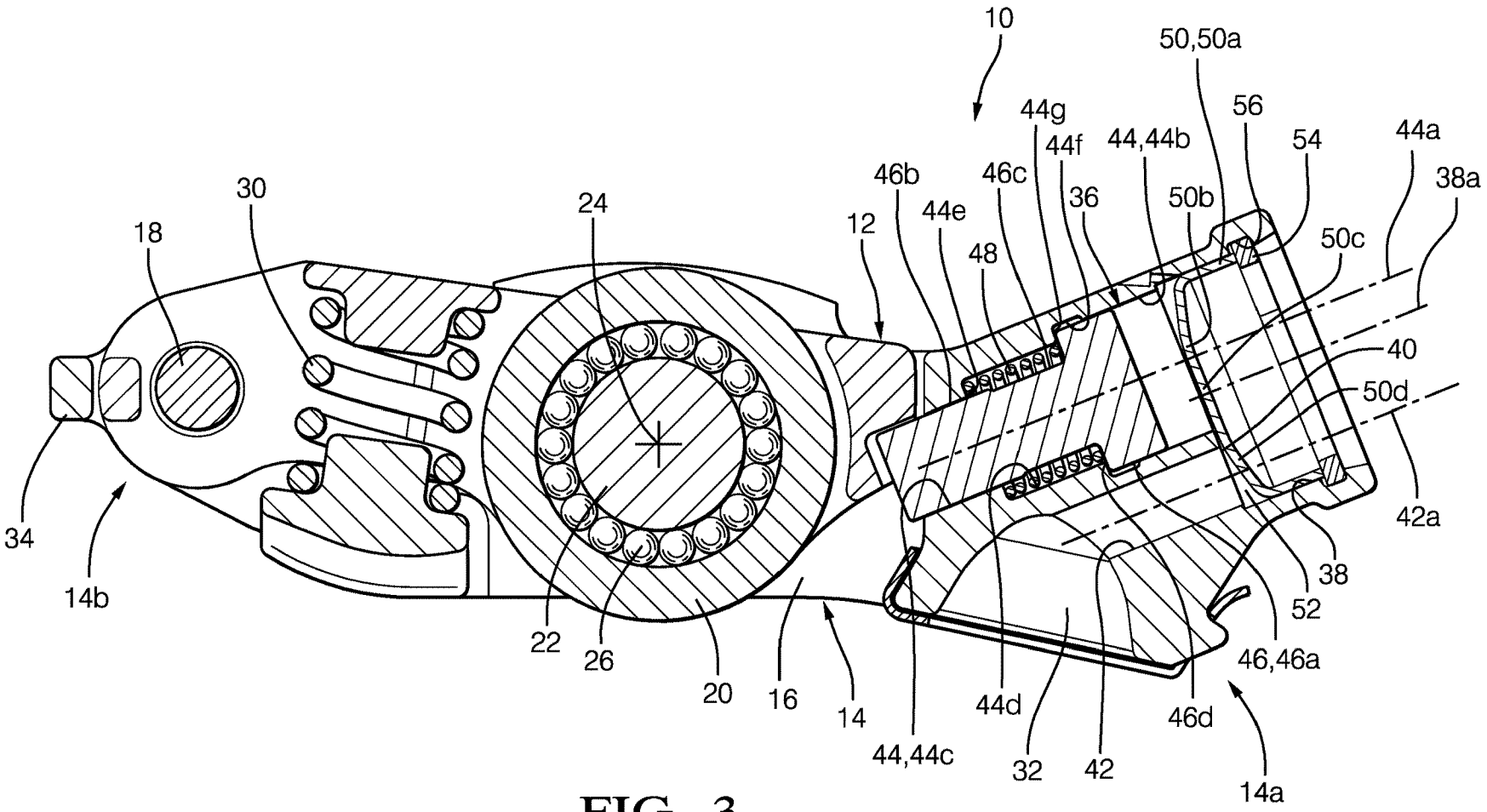
FIG. 3 is the cross-sectional view of FIG. 2, now showing the latching arrangement in a coupled state.

Rocker arm 10 is selectively switched between a coupled and a decoupled state by latching arrangement 36 which is actuated by application and venting of pressurized oil as will be described in greater detail later. In the coupled state as shown in FIG. 3, inner arm 12 is prevented from pivoting relative to outer arm 14 past a predetermined position of inner arm 12 relative to outer arm 14 in a first direction, shown as clockwise in FIG. 3. In this way, in the coupled state, inner arm 12, and therefore roller shaft 22, is coupled to outer arm 14, and rotation of the lifting cam is transferred from roller 20 through roller shaft 22 to pivotal movement of outer arm 14 about the lash adjuster which, in turn, reciprocates the associated valve. In the decoupled state as shown in FIG. 2, inner arm 12 is able to pivot relative to outer arm 14 past the predetermined position in the first direction. In this way, in the decoupled state, inner arm 12, and therefore roller shaft 22, is decoupled from outer arm 14. Thus, roller shaft 22 does not transfer rotation of the lifting cam to pivotal movement of outer arm 14, and the associated valve is not reciprocated. Rather, inner arm 12 together with roller 20 and roller shaft 22 reciprocate within central opening 16, thereby compressing and uncompressing lost motion spring 30 in a cyclic manner such that lost motion spring 30 biases inner arm 12 to pivot relative to outer arm 14 in a second direction, shown as counterclockwise in FIG. 2, which is opposite from the first direction.

Latching arrangement 36 will now be described in greater detail with continued reference to FIGS. 1-4. Latching arrangement 36 includes a connecting bore 38 which is centered about and extends along a connecting bore axis 38*a* into outer arm 14. Connecting bore 38 extends from the outer surface of outer arm 14 to a connecting bore floor 40 which terminates connecting bore 38. Connecting bore floor 40 may be perpendicular to connecting bore axis 38*a* as shown. Connecting bore 38 may comprise multiple diameters, however, the cross-sectional shape of connecting bore 38 taken perpendicular to connecting bore axis 38*a* at any point along connecting bore axis 38*a* is preferably a circle.

Latching arrangement 36 also includes an oil supply bore 42 which is centered about and extends along an oil supply bore axis 42*a*. The cross-sectional shape of oil supply bore 42 taken perpendicular to oil supply bore axis 42*a* at any point along oil supply bore axis 42*a* is preferably a circle, with the exception of where oil supply bore 42 meets socket 32 which provides for a non-symmetric cross-sectional shape. Oil supply bore 42 extends from socket 32 to connecting bore 38 such that oil supply bore 42 opens into connecting bore 38 through connecting bore floor 40. In this way, oil supply bore 42 provides fluid communication from socket 32 to connecting bore 38 and communicates pressurized oil to connecting bore 38. As is conventional in hydraulically actuated switchable rocker arms, oil supply bore 42 receives oil from the lash adjuster which is received within socket 32. As shown, oil supply bore axis 42*a* may be parallel to connecting bore axis 38*a*, however, oil supply bore axis 42*a* may alternatively be oblique to connecting bore axis 38*a*. Also as shown, oil supply bore axis 42*a* may be offset from connecting bore axis 38*a* in a direction perpendicular to connecting bore axis 38*a*.

Latching arrangement 36 also includes a lock pin bore 44 which is centered about and extends along a lock pin bore axis 44*a*. Lock pin bore 44 extends from central opening 16 to connecting bore 38 such that lock pin bore 44 opens into connecting bore 38 through connecting bore floor 40. Lock pin bore 44 may comprise multiple diameters, however, the cross-sectional shape of lock pin bore 44 taken perpendicular to lock pin bore axis 44*a* at any point along lock pin bore axis 44*a* is preferably a circle, with the exception of where lock pin bore 44 meets central opening 16 which provides for a non-symmetric cross-sectional shape. As shown, lock pin bore axis 44*a* is preferably parallel to connecting bore axis 38*a*. Also as shown, lock pin bore axis 44*a* may be offset from connecting bore axis 38*a* in a direction perpendicular to connecting bore axis 38*a*. As such, when oil supply bore axis 42*a* is parallel to connecting bore axis 38*a*, oil supply bore axis 42*a* is also parallel to lock pin bore axis 44*a* and when oil supply bore axis 42*a* is oblique to connecting bore axis 38*a*, oil supply bore axis 42*a* is also oblique to lock pin bore axis 44*a*. As illustrated in the figures, lock pin bore 44 and oil supply bore 42 are located laterally relative to each other and communicate via connecting bore 38, i.e. oil supply bore 42 does not open directly into lock pin bore 44 and vice versa.

Lock pin bore 44 will now be described in greater detail. Lock pin bore 44 includes a first lock pin bore section 44*b* which is proximal to, and opens into connecting bore 38 through connecting bore floor 40. Lock pin bore 44 also includes a second lock pin bore section 44*c* which is proximal to, and opens into central opening 16. Second lock pin bore section 44*c* is preferably smaller in diameter than first lock pin bore section 44*b*. Lock pin bore 44 also includes a third lock pin bore section 44*d* which is immediately axially adjacent to second lock pin bore section 44*c* such that third lock pin bore section 44*d* is axially between first lock pin bore section 44*b* and second lock pin bore section 44*c*. Third lock pin bore section 44*d* is preferably larger in diameter than second lock pin bore section 44*c*, thereby forming a first lock pin bore shoulder 44*e* where third lock pin bore section 44*d* meets second lock pin bore section 44*c*. Third lock pin bore section 44*d* is preferably smaller in diameter than first lock pin bore section 44*b*. Lock pin bore 44 may also include a fourth lock pin bore section 44*f* which is immediately axially adjacent to third lock pin bore section 44*d* and to first lock pin bore section 44*b* such that fourth lock pin bore section 44*f* is axially between first lock pin bore section 44*b* and third lock pin bore section 44*d*. Fourth lock pin bore section 44*f* is larger in diameter than first lock pin bore section 44*b* and third lock pin bore section 44*d*, thereby forming a second lock pin bore shoulder 44*g* where fourth lock pin bore section 44*f* meets third lock pin bore section 44*d*.

Latching arrangement 36 also includes a lock pin 46 within lock pin bore 44 which slides along lock pin bore axis 44*a* based on the magnitude of oil pressure supplied through oil supply bore 42. Lock pin 46 includes a first lock pin section 46*a* which is located within first lock pin bore section 44*b*. First lock pin section 46*a* is cylindrical and sized to mate with first lock pin bore section 44*b* in a close sliding fit which allows lock pin 46 to move axially within lock pin bore 44 while substantially preventing lock pin 46 from moving in a direction perpendicular to lock pin bore axis 44*a* and also substantially preventing oil from leaking between the interface of first lock pin section 46*a* and first lock pin bore section 44*b*. In this way, first lock pin section 46*a* acts as a hydraulic piston which allows pressurized oil from oil supply bore 42 to urge lock pin 46 into coupled state shown in FIG. 3. In order to allow this relationship, first lock pin section 46*a* and first lock pin bore section 44*b* may need to be machined in a finish grinding operation to obtain suitable tolerances and surface finishes. As will be readily be recognized by those of ordinary skill in the art, substantially preventing oil from leaking between the interface of first lock pin section 46*a* and first lock pin bore section 44*b* is an indication that some leakage may occur while still allowing sufficient pressure to act upon first lock pin section 46*a* to urge lock pin 46 into coupled state shown in FIG. 3. Any oil that may leak past the interface of first lock pin section 46*a* and first lock pin bore section 44*b* may be vented out of outer arm 14 through a vent passage that will not be further described herein. Lock pin 46 also includes a second lock pin section 46*b* which is supported within second lock pin bore section 44*c*. Second lock pin section 46*b* is cylindrical and sized to mate with second lock pin bore section 44*c* in a close sliding fit which allows lock pin 46 to move axially within lock pin bore 44 while substantially preventing lock pin 46 from moving in a direction perpendicular to lock pin bore axis 44*a*. When lock pin 46 is positioned in the coupled state shown in FIG. 3, a portion of second lock pin section 46*b* extends into central opening 16 and engages inner arm 12. While not shown, the tip of second lock pin section 46*b* which engages inner arm 12 may include a flat which engages inner arm 12. Lock pin 46 also includes a third lock pin section 46*c* which joins first lock pin section 46*a* and second lock pin section 46*b* such that third lock pin section 46*c* is smaller in diameter than first lock pin section 46*a* and second lock pin section 46*b*, thereby forming a lock pin shoulder 46*d* where third lock pin section 46*c* meets first lock pin section 46*a*. However, in an alternative, third lock pin section 46*c* may be omitted and lock pin shoulder 46*d* is formed where second lock pin section 46*b* meets first lock pin section 46*a*.

Latching arrangement 36 also includes a return spring 48 within lock pin bore 44 which urges lock pin 46 into the uncoupled state shown in FIG. 2. Return spring 48 circumferentially surrounds third lock pin section 46*c* and a portion of second lock pin section 46*b* such that return spring 48 is held in compression between first lock pin bore shoulder 44*e* and lock pin shoulder 46*d*. In this way, when the pressure of oil acting on first lock pin section 46*a* is sufficiently low, return spring 48 urges lock pin 46 into the uncoupled state shown in FIG. 2. Conversely, when the pressure of oil acting on first lock pin section 46*a* is sufficiently high, lock pin 46 is urged by the oil pressure into the coupled state as shown in FIG. 3 whereby return spring 48 is compressed. As shown in FIG. 3, second lock pin bore shoulder 44*g* limits the travel of lock pin 46 in the coupled state by providing a surface for lock pin shoulder 46*d* to contact.

Figure 4:
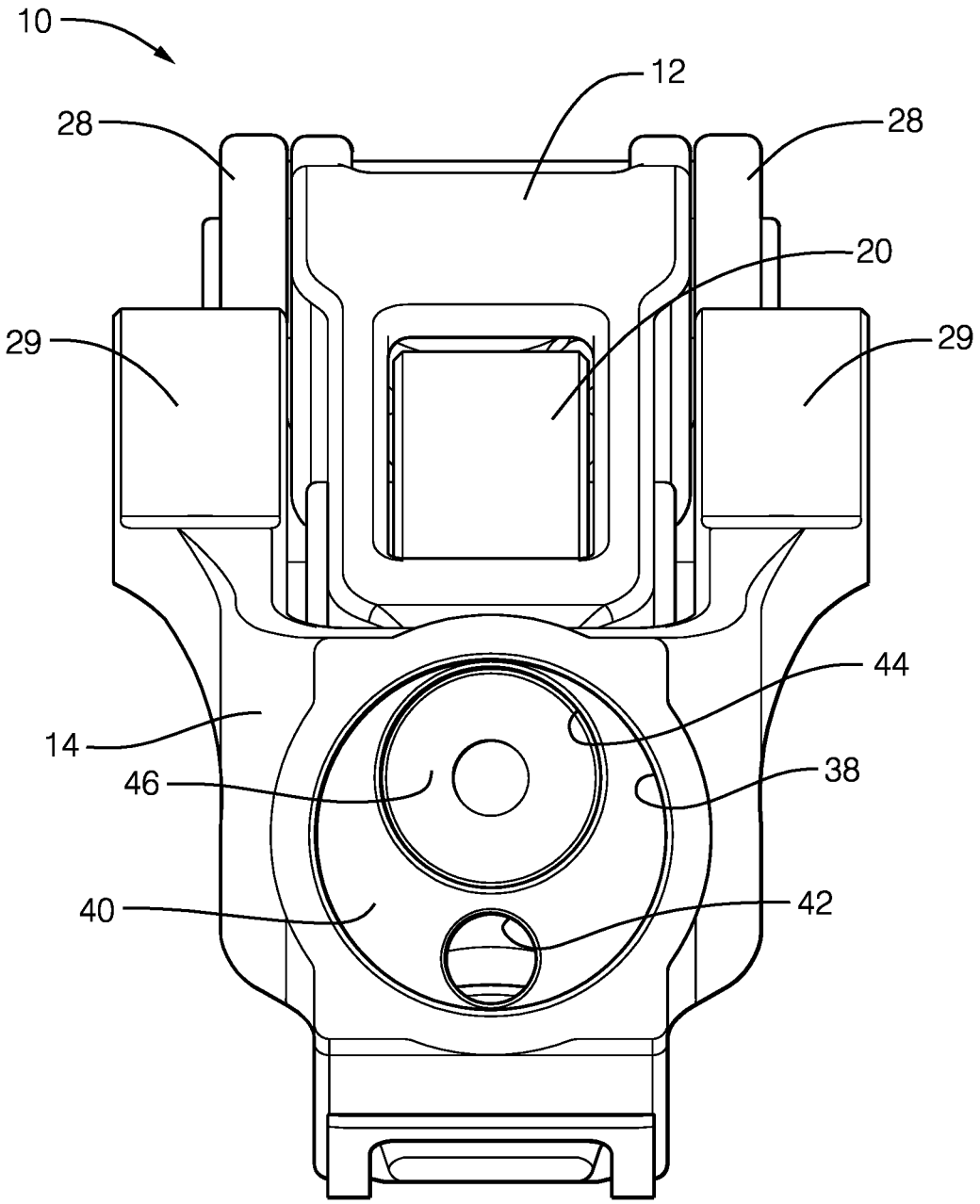
FIG. 4 is an isometric view of the rocker arm, shown with a retainer of the latching arrangement removed.

Latching arrangement 36 also includes a retainer 50 located within connecting bore 38 such that retainer 50 closes connecting bore 38 to define a chamber 52 within connecting bore 38 axially between retainer 50 and connecting bore floor 40 which provides fluid communication between oil supply bore 42 and lock pin bore 44. It should be noted that FIG. 4 is shown with retainer 50 removed in order to obtain a clear view of connecting bore 38, oil supply bore 42, and lock pin bore 44 viewed looking in the direction of connecting bore axis 38*a*. As shown in FIGS. 2 and 3, retainer 50 may be cup-shaped with an annular wall 50*a* centered about connecting bore axis 38*a* and an end wall 50*b* closing off the end of annular wall 50*a* that is proximal to connecting bore floor 40. Annular wall 50*a* is sized to mate with connecting bore 38 in an interference fit relationship which prevents oil from passing between the interface of annular wall 50*a* and connecting bore 38. End wall 50*b* includes a central section 50*c* surrounded by a peripheral section 50*d* such that central section 50*c* extends axially toward connecting bore floor 40 to a greater extent than peripheral section 50*d*. In this way, peripheral section 50*d* ensures that chamber 52 is sufficiently large to ensure adequate oil flow and pressure from oil supply bore 42 to lock pin bore 44. As shown, central section 50*c* may be perpendicular to connecting bore axis 38*a* while peripheral section 50*d* is oblique relative to connecting bore axis 38*a* such that peripheral section 50*d* tapers away from connecting bore floor 40 when moving from where peripheral section 50*d* meets central section 50*e* to where peripheral section 50*d* meets annular wall 50*a*. As best seen in FIG. 2, central section 50*c* acts as a travel stop for lock pin 46 when lock pin 46 is in the decoupled state such that lock pin 46 abuts the central section 50*c* while lock pin 46 is separated from peripheral section 50*d* when lock pin 46 is in the decoupled state. While the interference fit of annular wall 50*a* with connecting bore 38 may be sufficient to maintain the position of retainer 50 within connecting bore 38, additional retention may be desired. As shown, a clip 54 may be provided in a groove 56 of connecting bore 38 to ensure that the position of retainer 50 within connecting bore 38 is maintained. Alternative methods may be used to ensure retainer 50 that the position of retainer 50 within connecting bore 38 is maintained, for example, adhesives, welding, crimping, staking or combinations thereof.

Latching arrangement 36 as described herein allows for improved manufacturability of rocker arm 10 since oil supply bore 42 does not intersect, i.e. does not break into, lock pin bore 44, thereby allowing formation of oil supply bore 42 to be initiated at connecting bore floor 40. In this way, tooling have a manageable length to diameter ratio may be used to minimize tool breakage. Another benefit that results from latching arrangement 36 is reduced manufacturing time and cost of producing lock pin bore 44. More specifically, since lock pin bore 44 does not receive retainer 50, unlike the prior art, lock pin bore 44 is decreased in length which requires less time in producing the surface finish and tolerance required for lock pin bore 44 to interface with lock pin 46. Furthermore, connecting bore floor 40 of connecting bore 38 provides a surface which ensures that retainer 50 cannot be inserted too far, and therefore ensures a proper travel stop location for lock pin 46 in the decoupled state.

While this invention has been described in terms of preferred embodiments thereof, it is not intended to be so limited, but rather only to the extent set forth in the claims that follow.

We claim:

1. A rocker arm for transmitting rotational motion from a camshaft to opening and closing motion of a combustion valve in an internal combustion engine, said rocker arm comprising:

an outer arm with an outer follower;

an inner arm which selectively pivots relative to said outer arm, said inner arm having an inner follower; and a latching arrangement which switches said rocker arm between a coupled state and a decoupled state, said latching arrangement comprising:

a connecting bore which extends into said outer arm, said connecting bore being centered about and extending along a connecting bore axis such that said connecting bore is terminated by a connecting bore floor;

an oil supply bore in said outer arm which opens into said connecting bore through said connecting bore floor, said oil supply bore being centered about and extending along an oil supply bore axis;

a lock pin bore in said outer arm which opens into said connecting bore through said connecting bore floor, said lock pin bore being centered about and extending along a lock pin bore axis;

a lock pin located within said lock pin bore where said lock pin slides along said lock pin bore axis such that in said coupled state, said lock pin prevents said inner arm from pivoting relative to said outer arm past a predetermined position in a first direction and such that in said decoupled state said lock pin permits said inner arm to pivot relative to said outer arm past said predetermined position in said first direction; and a retainer within said connecting bore which defines a chamber within said connecting bore which provides fluid communication between said oil supply bore and said lock pin bore.

2. A rocker arm as in claim 1, wherein said lock pin bore axis is parallel to said connecting bore axis.

3. A rocker arm as in claim 2 wherein said lock pin bore axis is offset relative to said connecting bore axis perpendicular to said connecting bore axis.

4. A rocker arm as in claim 3 wherein said oil supply bore axis is parallel to said connecting bore axis.

5. A rocker arm as in claim 4 wherein said oil supply bore axis is offset relative to said connecting bore axis perpendicular to said connecting bore axis.

6. A rocker arm as in claim 5 wherein said oil supply bore axis is offset relative to said lock pin bore axis perpendicular to said lock pin bore axis.

7. A rocker arm as in claim 1, wherein said lock pin bore axis is parallel to said oil supply bore axis.

8. A rocker arm as in claim 7 wherein said lock pin bore axis is offset relative to said oil supply bore axis perpendicular to said oil supply bore axis.

9. A rocker arm as in claim 1 wherein said retainer comprises:

an annular wall which interfaces with said connecting bore to prevent oil from passing between said annular wall and said connecting bore; and an end wall which closes off an end of said annular wall which is proximal to said connecting bore floor.

10. A rocker arm as in claim 9 wherein said end wall comprises:

a central section; and a peripheral section surrounding said central section;

wherein said central section extends toward said connecting bore floor to a greater extent than said peripheral section.

11. A rocker arm as in claim 10 wherein said peripheral section is oblique relative to said connecting bore axis.

12. A rocker arm as in claim 11 wherein said lock pin abuts said central section of said end wall when said lock pin is in said decoupled state.

13. A rocker arm as in claim 11 wherein said lock pin is separated from said peripheral section of said end wall when said lock pin is in said decoupled state.

14. A rocker arm as in claim 1 wherein said oil supply bore does not intersect said lock pin bore.

* * * * *